US007243664B2

(12) United States Patent
Berger et al.

(10) Patent No.: US 7,243,664 B2
(45) Date of Patent: Jul. 17, 2007

(54) AUTOMATIC DISHWASHING COMPOSITION WITH CORROSION INHIBITORS

(75) Inventors: Patricia Sara Berger, Cincinnati, OH (US); Patti Jean Kellett, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/367,953

(22) Filed: Mar. 3, 2006

(65) Prior Publication Data

US 2006/0199750 A1 Sep. 7, 2006

Related U.S. Application Data

(60) Provisional application No. 60/658,703, filed on Mar. 4, 2005.

(51) Int. Cl.
*B08B 9/20* (2006.01)

(52) U.S. Cl. ..... 134/25.2; 510/514; 510/401; 510/220; 510/221; 134/26; 134/34; 134/36; 134/42; 134/25.3

(58) Field of Classification Search ..... 510/514, 510/401, 220, 221; 134/25.2, 25.3, 26, 34, 134/36, 42

See application file for complete search history.

(56) References Cited

U.S. PATENT DOCUMENTS

| | | | | |
|---|---|---|---|---|
| 3,245,915 | A | 4/1966 | Charnanjit et al. | |
| 4,105,573 | A * | 8/1978 | Jacobsen | 510/222 |
| 4,105,592 | A | 8/1978 | Collins | |
| 4,199,467 | A | 4/1980 | Novosel et al. | |
| 4,199,483 | A | 4/1980 | Jones | |
| 4,539,133 | A | 9/1985 | Boskamp | |
| 4,846,993 | A * | 7/1989 | Lentsch et al. | 510/222 |
| 4,859,358 | A | 8/1989 | Gabriel et al. | |
| 4,992,195 | A | 2/1991 | Dolan et al. | |
| 4,992,212 | A | 2/1991 | Corring et al. | |
| 5,531,934 | A | 7/1996 | Freeman et al. | |
| 5,543,490 | A | 8/1996 | Groth et al. | |
| 5,545,348 | A | 8/1996 | Savio | |
| 5,726,280 | A | 3/1998 | Uhr et al. | |
| 5,843,877 | A | 12/1998 | Park et al. | |
| 5,888,954 | A | 3/1999 | Haerer et al. | |
| 6,150,324 | A * | 11/2000 | Lentsch et al. | 510/446 |
| 6,156,715 | A | 12/2000 | Lentsch et al. | |
| 6,410,495 | B1 | 6/2002 | Lentsch et al. | |
| 6,489,287 | B1 | 12/2002 | Gauthier et al. | |
| 6,664,220 | B2 | 12/2003 | Mayhall et al. | |
| 6,686,325 | B2 | 2/2004 | Hoyt et al. | |
| 2003/0027742 | A1* | 2/2003 | Reierson et al. | 510/510 |
| 2004/0180807 | A1* | 9/2004 | Song et al. | 510/521 |
| 2005/0137105 | A1* | 6/2005 | Griese et al. | 510/220 |
| 2005/0137107 | A1* | 6/2005 | Griese et al. | 510/220 |
| 2006/0051862 | A1 | 3/2006 | Amit et al. | |
| 2006/0069001 | A1* | 3/2006 | Song | 510/220 |
| 2006/0069005 | A1* | 3/2006 | Song | 510/220 |
| 2006/0094634 | A1 | 5/2006 | Jekel et al. | |
| 2006/0116309 | A1 | 6/2006 | Lambotte et al. | |

FOREIGN PATENT DOCUMENTS

| | | | |
|---|---|---|---|
| CH | 673 033 | A5 | 1/1990 |
| EP | 0288812 | B1 | 8/1991 |
| EP | 0561464 | A1 | 9/1993 |
| EP | 0682105 | A2 | 11/1995 |
| EP | 0872543 | A2 | 10/1998 |
| EP | 0876465 | B1 | 4/2000 |
| EP | 0832969 | B1 | 11/2004 |
| FR | 2 304 667 | | 10/1976 |
| JP | 10036986 | A | 2/1998 |
| JP | 2000144196 | A | 5/2000 |
| JP | 2000230194 | A | 8/2000 |
| WO | WO 96/37593 | | 11/1996 |
| WO | WO 2005/028527 | A1 | 3/2005 |
| WO | WO 2005026304 | A1 | 3/2005 |

OTHER PUBLICATIONS

J. D. Morrison, Study of Corrosion Protection Methods for GSE Applications at Kennedy Space Center, Status Report, May 1972, John F. Kennedy Space Center, Materials Testing Branch, Kennedy Space Center, Florida.

P. J. Hidalgo, Pitting Corrosion of Martensitic Cutlery Steels, Surface Technology, 10 (1980) 193-208, Departamento de Materiales y Resistencia, Escuela Técnica Superior ICAI, , Madrid, Spain.

Alla Furman, Margarita Kharshan, Methodology of VCI's For Water Treatment, National Association of Corrosion Engineers, 1997, Paper #182, New Orleans.

A. Subramanian, M. Natesan. V.S. Muralidharan, K. Balakrishnan and T. Vasudevan, An Overview: Vapor Phase Corrosion Inhibitors, Feb. 2000, pp. 144-155, Corrosion—vol. 56, No. 2, Department of Industrial Chemistry, Indiana.

B. Miksic, R. Boyle, and B. Wuentz, Efficacy of Vapor Phase Corrosion Inhibitor Technology in Manufacturing, The Journal of Science and Engineering, Jun. 2004, vol. 60, No. 6, pp. 515-522.

PCT International Search Report - 3 Pages.

* cited by examiner

*Primary Examiner*—Sharidan Carrillo
(74) *Attorney, Agent, or Firm*—Laura R. Grunzinger

(57) ABSTRACT

A method of preventing corrosion of metals such as stainless steel, carbon steel and chrome plated flatware in automatic dishwashers through the use of a corrosion inhibitor in an automatic dishwashing detergent composition.

9 Claims, No Drawings

AUTOMATIC DISHWASHING COMPOSITION WITH CORROSION INHIBITORS

CROSS REFERENCE TO RELATED APPLICATION

This application claims priority under 35 U.S.C. § 119(e) to U.S. provisional application No. 60/658,703, filed Mar. 4, 2005.

FIELD OF THE INVENTION

The present invention relates to the automatic dishwashing compositions comprising corrosion inhibitors and methods of using the same.

BACKGROUND OF THE INVENTION

Corrosion inhibitors have been utilized for many years to protect corrosion of metal parts. The corrosion inhibitors are compounds that form an extremely thin film over selected metal surfaces. As corrosion is an electrochemical process, the formation of the thin film of the corrosion inhibitors acts as an electron acceptor and the metal surface, containing an oxide coating, acts as an electron donor. See also, *An Overview: Corrosion Inhibitors*; Subramaniam, A. et al., Corrosion Vol. 56, No. 2, pages 144–155.

Metals exposed to the environment of an automatic dishwasher endure corrosive conditions such as high electroyte concentration, high humidity, high pH, high temperature, contact with bleach, shear stresses from foreign matter such as soils, different aeration and concentrations based on the shape of the dishware and relatively long and repeated periods of exposure to the discussed elements.

Stainless steel, comprising an alloy of chromium, nickel and steel, is often the alloy of choice for cookware, flatware and other cooking utensils. Carbon steel cooking surfaces and chrome plated cookware and cooking utensils also are prevalent in consumers' kitchens. Many consumers utilize automatic dishwashers to clean cookware, flatware and cooking utensils. However, stainless steel is relatively susceptible to corrosion under the described automatic dishwasher conditions. The properties and corrosion factors of stainless steel are distinct from that of sterling silver and traditional solutions utilized for sterling silver do not prove to be useful for stainless steel. Like sterling silver, tarnishing of stainless steel as well as rusting is often identified as corrosion in stainless steel.

Therefore, there exists a need to provide protection to stainless steel metals in automatic dishwasher conditions while continuing to provide acceptable levels of cleaning and spotting. The corrosion inhibitor must be able to be formulatible in an automatic dishwashing composition comprising such additives as bleach and enzymes as well as be safe to use on dishware.

SUMMARY OF THE INVENTION

The present invention relates to a method of preventing corrosion of stainless steel, carbon steel and chrome plated flatware in an automatic dishwashing machine environment comprising the steps of placing stainless steel in an automatic dishwashing machine; and contacting the stainless steel with an automatic dishwashing composition comprising a corrosion inhibitor.

DETAILED DESCRIPTION OF THE INVENTION

The present invention relates to a method of preventing corrosion of stainless steel, carbon steel and chrome plated flatware via the use of an automatic dishwashing composition comprising an effective amount of a corrosion inhibitor. The automatic dishwashing composition may be in any acceptable form. The automatic dishwashing composition may be in the form of a through-the-wash formulation, a through-the-rinse formulation or may be released during the drying stage. The automatic dishwashing composition also includes a composition that is used as an additive in addition to one or more other automatic dishwashing compositions.

Cooking utensils and tableware which are cleaned in automatic dishwashing machines pass through various washing cycles or, as is encountered in a commercial type automatic dishwashing machine, stages of the machine. The cycles or stages usually include a pre-rinse of warm water, followed by one or more spray washings of an aqueous solution of a detergent composition. A final step in each of the types of machines includes a water rinse to wash away residual detergent composition and loosened soil. Optionally, a separate dispenser is provided in the final rinse cycle or stage to deliver a rinse aid composition to the rinse water. This rinse aid composition contains a nonionic detergent to promote wetting and to produce a sheet flow, thereby reducing water spotting. Additionally the rinse aid composition increases the run-off speed of the water and reduces the drying time during the drying phase.

As used herein "through-the-wash" means the time period of the washing cycle of an automatic dishwashing machine where one or more spray washings of an aqueous solution is occurring.

As used herein "through-the-rinse" means the time period of the washing cycle of an automatic dishwashing machine where the option final rinse cycle or stage is occurring.

As used herein "drying phase" means the time period of the washing cycle of an automatic dishwashing machine where optionally heat is introduced into the automatic dishwashing machine, generally the last cycle or stage.

As used herein "an effective amount" means an amount of the corrosion inhibitor that is sufficient under testing conditions to prevent or reduce metal corrosion on stainless steel, carbon steel and/or chrome plated flatware verses a composition not comprising the metal corrosion inhibitor under the same conditions.

With reference to the polymers described herein, the term weight-average molecular weight is the weight-average molecular weight as determined using gel permeation chromatography according to the protocol found in Colloids and Surfaces A. Physico Chemical & Engineering Aspects, Vol. 162, 2000, pg. 107–121. The units are Daltons.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Corrosion Inhibitors

The corrosion inhibitor should be formulatible and safe for use on eating and cooking surfaces such as tableware, cookware, flatware, glasses, and similar cooking or eating surfaces. Suitable materials for the corrosion inhibitor for use in the compositions herein include: a mixture of benzoic acid, ethanolamines and di-fatty acids (e.g. sebacic acid) sold under the commercial name of Cortec® S-69 available from the Cortec Corporation; a mixture of cyclohexylamine, benzoic acid, ethanolamines and di-fatty acids (e.g. sebacic acid) available from Cortec Corporation; phosphate ester sold under the commercial name Berol® 725 from Akzo Nobel Surface Chemistry LLC, phosphate ester/trienthanolamine (1:4 molar ratio) sold under the commercial name Maphos® 43T from the BASF Corporation; disodium ethyl and butyl phophonate silica sold under the tradename Phosphonics P-04-002*a/b* from PhosphonicS; phosphonate sold under the tradename Mirapol® A400 available from Rhodia; a mixture of alkyne nonionic surfactant sold under the tradename Surfynol® 61 and a methyl butyrol, both available from Air Products and Chemicals, Inc.; and any combinations of the above mentioned corrosion inhibitors.

The corrosion inhibitor is present in the automatic dishwashing composition from about 0.1% to about 50% by weight of the automatic dishwashing composition. If a "through-the-wash" composition then the corrosion inhibitor is present from about 0.25% to about 3% by weight of the automatic dishwashing composition. If a "through-the-rinse" composition then the corrosion inhibitor is present from about 0.5% to about 50% by weight of the automatic dishwashing composition.

Nonionic Surfactant

Suitable nonionic surfactants also include, but are not limited to low-foaming nonionic (LFNI) surfactants. A LFNI surfactant is most typically used in an automatic dishwashing composition because of the improved water-sheeting action (especially from glassware) which they confer to the automatic dishwashing composition. They also may encompass non-silicone, phosphate or nonphosphate polymeric materials which are known to defoam food soils encountered in automatic dishwashing. The LFNI surfactant may have a relatively low cloud point and a high hydrophilic-lipophilic balance (HLB). Cloud points of 1% solutions in water are typically below about 32° C. and alternatively lower, e.g., 0° C., for optimum control of sudsing throughout a full range of water temperatures. If desired, a biodegradable LFNI surfactant having the above properties may be used.

A LFNI surfactant may include, but is not limited to: alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof. Polymeric compounds made from a sequential ethoxylation and propoxylation of initiator compounds with a single reactive hydrogen atom, such as $C_{12-18}$ aliphatic alcohols, do not generally provide satisfactory suds control in Automatic dishwashing compositions. However, certain of the block polymer surfactant compounds designated as PLURONIC® and TETRONIC® by the BASF-Wyandotte Corp., Wyandotte, Mich., are suitable in Automatic dishwashing compositions.

The LFNI surfactant can optionally include a propylene oxide in an amount up to about 15% by weight. Other LFNI surfactants can be prepared by the processes described in U.S. Pat. No. 4,223,163. The LFNI surfactant may also be derived from a straight chain fatty alcohol containing from about 16 to about 20 carbon atoms ($C_{16}$–$C_{20}$ alcohol), alternatively a $C_{18}$ alcohol, condensed with an average of from about 6 to about 15 moles, or from about 7 to about 12 moles, and alternatively, from about 7 to about 9 moles of ethylene oxide per mole of alcohol. The ethoxylated nonionic surfactant so derived may have a narrow ethoxylate distribution relative to the average.

In certain embodiments, a LFNI surfactant having a cloud point below 30° C. may be present in an amount from about 0.01% to about 60%, or from about 0.5% to about 10% by weight, and alternatively, from about 1% to about 5% by weight of the composition.

Adjunct Ingredients

Any suitable adjunct ingredient in any suitable amount or form may be used. For an example, a detergent active and/or rinse aid active, adjuvant, and/or additive, may be used in combination the corrosion inhibitor. Suitable adjunct ingredients include, but are not limited to, cleaning agents, surfactant other than the nonionic surfactants discussed above for example, anionic, cationic, amphoteric, zwitterionic, and mixtures thereof, chelating agent/sequestrant blend, bleaching system (for example, chlorine bleach, oxygen bleach, bleach activator, bleach catalyst, and mixtures thereof), enzyme (for example, a protease, lipase, amylase, and mixtures thereof), alkalinity source, water softening agent, secondary solubility modifier, thickener, acid, soil release polymer, dispersant polymer, thickeners, hydrotrope, binder, carrier medium, antibacterial active, detergent filler, abrasive, suds suppressor, defoamer, anti-redeposition agent, threshold agent or system, aesthetic enhancing agent (i.e., dye, colorants, perfume, etc.), oil, solvent, and mixtures thereof.

Zinc-Containing Materials

In one embodiment, particulate zinc-containing materials (PZCMs) and zinc-containing layered materials (ZCLMs), for treating glassware surfaces may be added as adjunct ingredients. Particulate zinc-containing materials (PZCMs) remain mostly insoluble within formulated compositions. Examples of PZCMs useful in certain non-limiting embodiments may include the following: inorganic material such as zinc aluminate, zinc carbonate, zinc oxide and materials containing zinc oxide (i.e., calamine), zinc phosphates (i.e., orthophosphate and pyrophosphate), zinc selenide, zinc sulfide, zinc silicates (i.e., ortho- and meta-zinc silicates), zinc silicofluoride, zinc borate, zinc hydroxide and hydroxy sulfate, and ZCLMs. PZCMs as glass corrosion protection agents require that the $Zn^{2+}$ ion be chemically available without being soluble.

Many ZCLMs occur naturally as minerals. Common examples include hydrozincite (zinc carbonate hydroxide), basic zinc carbonate, aurichalcite (zinc copper carbonate hydroxide), rosasite (copper zinc carbonate hydroxide) and many related minerals that are zinc-containing. Natural ZCLMs can also occur wherein anionic layer species such as clay-type minerals (e.g., phyllosilicates) contain ion-exchanged zinc gallery ions. Other suitable ZCLMs include the following: zinc hydroxide acetate, zinc hydroxide chloride, zinc hydroxide lauryl sulfate, zinc hydroxide nitrate, zinc hydroxide sulfate, hydroxy double salts, and mixtures thereof. Natural ZCLMs can also be obtained synthetically or formed in situ in a composition or during a production process.

Commercially available sources of zinc carbonate include zinc carbonate basic (Cater Chemicals: Bensenville, Ill., USA), zinc carbonate (Shepherd Chemicals: Norwood, Ohio, USA), zinc carbonate (CPS Union Corp.: New York, N.Y., USA), zinc carbonate (Elementis Pigments: Durham, UK), and zinc carbonate AC (Bruggemann Chemical: Newtown Square, Pa., USA).

Any suitable PZCM or more particularly ZCLM in any suitable amount may be used. Suitable amounts of a PZCM include, but are not limited to: a range: from about 0.001% to about 20%, or from about 0.001% to about 10%, or from about 0.01% to about 7%, and alternatively, from about 0.1% to about 5% by weight of the composition.

Suds Suppressor

Any suitable suds suppressor in any suitable amount or form may be used. Suds suppressors suitable for use may be low foaming and include low cloud point nonionic surfactants (as discussed above) and mixtures of higher foaming surfactants with low cloud point nonionic surfactants which act as suds suppressors therein (see WO 93/08876; EP 0 705 324, U.S. Pat. No. 6,593,287, U.S. Pat. No. 6,326,341 and U.S. Pat. No. 5,576,281.

Suitable suds suppressor can be selected from the group consisting of silicon based antifoams, particularly conventional inorganic-filled polydimethylsiloxane antifoam agents, especially silica-filled polydimethylsiloxane antifoam agents as disclosed in U.S. Pat. No. 4,639,489 and U.S. Pat. No. 3,455,839. These and other suitable suds suppressor are commercially available under the tradenames of SILCOLAPSE® 431 and SILICONE EP® 6508 from ICI United States Inc., Wilmington, Del., U.S.A., RHODOSIL® 454 from Rhone-Poulenc Chemical Co., Monmouth Junction, N.J., U.S.A.; and SILKONOL AK® 100 commercially available from Wacker-Chemie G.m.b.H., Munich, Federal Republic of Germany.

In certain embodiments, one or more suds suppressors may be present in an amount from about 0% to about 30% by weight, or about 0.2% to about 30% by weight, or from about 0.5% to about 10%, and alternatively, from about 1% to about 5% by weight of the automatic dishwashing composition.

Builder System

Any suitable builder system comprising any suitable builder in any suitable amount or form may be used. In one embodiment a builder system may be present from about 5% to about 50%, from about 10% to about 40%, from about 15% to about 35% by weight of the automatic dishwashing composition. Any conventional builder is suitable for use herein. For example, suitable builders include, but are not limited to: citrate, phosphate (such as sodium tripolyphosphate (STPP), potassium tripolyphosphate (KTPP), mixed sodium and potassium tripolyphosphate (SKTP), sodium or potassium or mixed sodium and potassium pyrophosphate), aluminosilicate materials, silicates, polycarboxylates and fatty acids, materials such as ethylene-diamine tetraacetate, metal ion sequestrants such as aminopolyphosphonates, ethylenediamine tetramethylene phosphonic acid and diethylene triamine pentamethylene-phosphonic acid.

Enzyme

Any suitable enzyme and/or enzyme stabilizing system in any suitable amount or form may be used. Enzymes suitable for use include, but are not limited to: proteases, amylases, lipases, cellulases, peroxidases, and mixtures thereof. Amylases and/or proteases are commercially available with improved bleach compatibility. In practical terms, the composition may comprise an amount up to about 5 mg, more typically about 0.01 mg to about 3 mg by weight, of active enzyme per gram of the composition. Protease enzymes are usually present in such commercial preparations at levels sufficient to provide from 0.005 to 0.1 Anson units (AU) of activity per gram of composition, or 0.01%–1% by weight of a commercial enzyme preparation.

In certain embodiments, enzyme-containing compositions, especially liquid, liquid gel, and gel compositions, may comprise from about 0.0001% to about 10%; from about 0.005% to about 8%; from about 0.01% to about 6%, by weight of the composition of an enzyme stabilizing system. The enzyme stabilizing system can be any stabilizing system that is compatible with the detersive enzyme. Such stabilizing systems can include, but are not limited to: calcium ions, boric acid, propylene glycol, short chain carboxylic acid, boronic acid, and mixtures thereof.

Bleaching System

Any suitable bleaching agent or system in any suitable amount or form may be used. Bleaching agents suitable for use include, but are not limited to: chlorine and oxygen bleaches. In certain embodiments, a bleaching agent or system may be present in an amount from about 0% to about 30% by weight, or about 1% to about 15% by weight, or from about 1% to about 10% by weight, and alternatively from about 2% to about 6% by weight of the composition.

Suitable bleaching agents include, but are not limited to: inorganic chlorine (such as chlorinated trisodium phosphate), organic chlorine bleaches (such as chlorocyanurates, water-soluble dichlorocyanurates, sodium or potassium dichloroisocyanurate dihydrate, sodium hypochlorite and other alkali metal hypochlorites); inorganic perhydrate salts (such as sodium perborate mono- and tetrahydrates and sodium percarbonate, which may be optionally coated to provide controlled rate of release as disclosed in UK Pat. No. GB 1466799 on sulfate/carbonate coatings), preformed organic peroxyacids, and mixtures thereof.

Peroxygen bleaching compounds can be any peroxide source comprising sodium perborate monohydrate, sodium perborate tetrahydrate, sodium pyrophosphate peroxyhydrate, urea peroxyhydrate, sodium percarbonate, sodium peroxide, and mixtures thereof. In other non-limiting embodiments, peroxygen-bleaching compounds may comprise sodium perborate monohydrate, sodium perborate tetrahydrate, sodium percarbonate, and mixtures thereof.

The bleaching system may also comprise transition metal-containing bleach catalysts, bleach activators, and mixtures thereof. Bleach catalysts suitable for use include, but are not limited to: the manganese triazacyclononane and related complexes (see U.S. Pat. No. 4,246,612, U.S. Pat. No. 5,227,084); Co, Cu, Mn and Fe bispyridylamine and related complexes (see U.S. Pat. No. 5,114,611); and pentamine acetate cobalt (III) and related complexes (see U.S. Pat. No. 4,810,410) at levels from 0% to about 10.0%, by weight; and alternatively, from about 0.0001% to about 1.0% by weight of the composition.

Typical bleach activators suitable for use include, but are not limited to: peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP 0 170 386); and benzoxazin peroxyacid precursors (EP 0 332 294 and EP 0 482 807) at levels from 0% to about 10.0%, by weight; or from 0.1% to 1.0% by weight of the composition.

Dispersant Polymer

Any suitable dispersant polymer in any suitable amount may be used. Suitable dispersant polymers include unsaturated monomeric acids that can be polymerized including acrylic acid, maleic acid (or maleic anhydride), fumaric acid, itaconic acid, aconitic acid, mesaconic acid, citraconic acid and methylenemalonic acid. The molecular weight of the polymer can vary over a wide range, for instance from about 1000 to about 500,000, alternatively from about 1000 to about 250,000. Further suitable dispersant polymers derived from unsaturated monomeric acids include, but are not limited to those disclosed in U.S. Pat. No. 3,308,067; U.S. Pat. No. 3,308,067; U.S. Pat. No. 4,379,080 U.S. Pat. No. 4,530,766, U.S. Pat. No. 5,084,535; and EP 0 066 915.

Other suitable dispersant polymers include polyethylene glycols and polypropylene glycols having a molecular weight of from about 950 to about 30,000, which can be obtained from the Dow Chemical Company of Midland, Mich. Such compounds for example, having a melting point within the range of from about 30° C. to about 100° C. can be obtained at molecular weights of 1450, 3400, 4500, 6000, 7400, 9500, and 20,000.

Suitable dispersant polymers also include the polyaspartate, carboxylated polysaccharides, particularly starches, celluloses and alginates, described in U.S. Pat. No. 3,723,322; the dextrin esters of polycarboxylic acids disclosed in U.S. Pat. No. 3,929,107; the hydroxyalkyl starch ethers, starch esters, oxidized starches, dextrins and starch hydrolysates described in U.S. Pat. No. 3,803,285; the carboxylated starches described in U.S. Pat. No. 3,629,121; and the dextrin starches described in U.S. Pat. No. 4,141,841.

Suitable cellulose dispersant polymersinclude, but are not limited to: cellulose sulfate esters (for example, cellulose acetate sulfate, cellulose sulfate, hydroxyethyl cellulose sulfate, methylcellulose sulfate, hydroxypropylcellulose sulfate, and mixtures thereof), sodium cellulose sulfate, carboxymethyl cellulose, and mixtures thereof.

In certain embodiments, a dispersant polymer may be present in an amount in the range from about 0.01% to about 25%, or from about 0.1% to about 20%, and alternatively, from about 0.1% to about 7% by weight of the composition.

Carrier Medium

Any suitable carrier medium in any suitable amount in any suitable form may be used. Suitable carrier mediums include both liquids and solids depending on the form of the automatic dishwashing composition. A solid carrier medium may be used in dry powders, granules, tablets, encapsulated products, and combinations thereof. Suitable solid carrier mediums include, but are not limited to carrier mediums that are non-active solids at ambient temperature. For example, any suitable organic polymer, such as polyethylene glycol (PEG), may be used. In certain embodiments, the solid carrier medium may be present in an amount in the range from about 0.01% to about 20%, or from about 0.01% to about 10%, and alternatively, from about 0.01% to about 5% by weight of the composition.

Suitable liquid carrier mediums include, but are not limited to: water (distilled, deionized, or tap water), solvents, and mixtures thereof. The liquid carrier medium may be present in an amount in the range from about 1% to about 90%, or from about 20% to about 80%, and alternatively, from about 30% to about 70% by weight of the composition. In through the rinse applications of the composition, low molecular weight primary or secondary alcohols selected from the group consisting of: methanol, ethanol, propanol, isopropanol, glycerol, propylene glycol, ethylene glycol, 1,2-propanediol, sorbitol and mixtures thereof may be utilized. The solvents for a through the rinse application is used suitably at a level of from about 5% to about 40%, preferably from about 10% to about 35% and more preferably form about 15% to about 25% by weight of the composition. The liquid carrier medium, however, may also contain other materials which are liquid, or which dissolve in the liquid carrier medium at room temperature, and which may also serve some other function besides that of a carrier. These materials include, but are not limited to: dispersants, hydrotropes, and mixtures thereof.

The composition can be provided in a "concentrated" system. For example, a concentrated liquid composition may contain a lower amount of a suitable carrier medium, compared to conventional liquid automatic dishwasher compositions. Suitable carrier medium content of the concentrated system may be present in an amount from about 30% to about 99.99% by weight of the concentrated composition. The dispersant content of the concentrated system may be present in an amount from about 0.001% to about 10% by weight of the concentrated automatic dishwashing composition.

Dispersant and Crystal Growth Inhibitors

Another adjunct ingredient that may be utilized is a dispersant and crystal growth inhibitors. The function of the dispersant is to suspend the inorganic salts in the wash liquor and minimize their deposition onto dishware. Some dispersants can also act as crystal growth inhibitors.

Suitable for use as dispersants herein are co-polymers synthesized from acrylic acid, maleic acid and methacrylic acid such as ACUSOL® 480N supplied by Rohm & Haas and polymers containing both carboxylate and sulphonate monomers, such as ALCOSPERSE® polymers (supplied by Alco).

Preferred crystal growth inhibitors for use herein include organodiphosphonic acids. By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1,1-diphosphonic acid (HEDP) and may be present in partially or fully ionized form, particularly as a salt or complex.

Humectants

Another adjunct ingredient for the present composition may be selected as a humectant. Humectants are a substance which can pick up or emit moisture to the surroundings depending on the surrounding relative humidity. Humectants suitable for use herein include non-aqueous hydrophilic organic solvents inclusive of glycols and polyhydric alcohols, for example sorbitol, glycerol, dipropylene glycol and mixtures thereof.

Product Form

Any suitable product form may be used. Suitable product forms include, but not limited to: solids, granules, powders, liquids, gels, pastes, semi-solids, tablets, water-soluble pouches, and combinations thereof. In a preferred embodiment of the present invention the composition forms part of a multi-phase unit dose product, preferably a dual compartment water-soluble pouch, wherein one of the phases preferably comprises a main wash detergent composition.

Preferred compositions and manufacturing methods for unit dose executions are described in WO 02/42408. Any water-soluble film-forming polymer which is compatible with the compositions of the invention and which allows the delivery of the composition into the rinse cycle can be employed in the unit dose embodiment. The film should remains intact during the wash cycle and only dissolves at the beginning of or during the rinse cycle. This can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916.

The automatic dishwashing composition suitable herein can be dispensed from any suitable device, including but not limited to: dispensing baskets or cups, bottles (pump assisted bottles, squeeze bottles, etc.), mechanic pumps, multi-compartment bottles, capsules, multi-compartment capsules, paste dispensers, and single- and multi-compartment water-soluble pouches, and combinations thereof. For example, a multi-phase tablet, a water-soluble or water-dispersible pouch, and combinations thereof, may be used to deliver the corrosion inhibitor to the desired substrate. The automatic dishwashing composition may take the form of an additive that is used in addition to one or more other automatic dishwashing compositions.

Delivery of the corrosion inhibitor may be through solutions including but are not limited to: hot and/or cold water, wash and/or rinse liquor, drying stage, and combinations thereof.

EXAMPLES

The following examples of automatic dishwashing compositions are provided for purposes of showing certain embodiments, and as such are not intended to be limiting in any manner.

TABLE 1

Liquid/Gel AUTOMATIC DISHWASHING Detergent Composition

| Ingredients | 1 (wt %) | 2 (wt %) | 3 (wt %) | 4 (wt %) |
|---|---|---|---|---|
| STPP/SKTP/KTPP | 17.3 | 20.5 | 15.0 | 15.0 |
| Zinc sulfate | — | 0.67 | — | 0.67 |
| hydrozincite | 0.12 | — | 0.12 | — |
| thickener | 0.94 | 1.20 | 1.0 | 1.20 |
| Sodium hydroxide | 0.4 | — | 2.3 | — |
| Potassium hydroxide | 2.82 | 13.04 | — | 13.04 |
| Sodium silicate | 14.56 | — | 19.37 | — |
| $H_2SO_4$ | — | 4.23 | — | 4.23 |
| Sodium benzoate | 2.25 | 0.3 | 2.0 | 0.2 |
| Sodium hypochlorite | 7.99 | — | 6.3 | — |
| Protease enzyme | — | 0.6 | — | 0.6 |
| Natalase enzyme | — | 0.16 | — | 0.16 |
| Boric acid | — | 3.0 | — | 3.0 |
| corrosion inhibitor[1] | 1.0 | 1.0 | 1.0 | 1.0 |
| Dye/perfume/speckles/water | Balance | Balance | Balance | Balance |

[1]any of the corrosion inhibitors or mixture of corrosion inhibitors listed above.

TABLE 2

Granular or Powder AUTOMATIC DISHWASHING Detergent Composition

| Ingredients | 5 (wt %) | 6 (wt %) |
|---|---|---|
| STPP/SKTP/KTPP | 18 | 27.44 |
| Sodium sulfate | 30.75 | 21.49 |
| Sodium carbonate | 30.0 | 30.0 |
| Sodium silicate | 12.25 | 8.98 |
| nonionic surfactant[1] | 0.88 | 1.76 |
| Dispersant polymer[2] | — | 2.27 |
| Dosodium perborate monohydrate | 4.0 | 4.25 |
| Enzyme[3] | 0.38 | 1.11 |
| Corrosion inhibitor[4] | 1.0 | 1.0 |
| Dye/perfume/speckles/filler/water | Balance | Balance |

[1]such as Polytergent ® SLF-18 from the BASF Corporation
[2]such as Alcosperse ® 246 available from Alco Chemicals
[3]one or more enzymes such as protease, amylase, savinase, natalase and mixtures thereof.
[4]any of the corrosion inhibitors or mixture of corrosion inhibitors listed above.

TABLE 3

Tablet/Water-soluble Pouch AUTOMATIC DISHWASHING Detergent Composition

| Ingredients | 7 (wt %) | 8 (wt %) | 9 (wt %) |
|---|---|---|---|
| STPP/SKTP/KTPP | 32.0 | 36.32 | 36.32 |
| Sodium silicate | 4.52 | 8.5 | 8.5 |
| Sodium carbonate | 21.75 | 26.0 | 26.44 |
| Sodium disilicate | 2.36 | — | — |
| Nonionic surfactant[1] | 1.42 | 1.6 | 1.6 |
| Dispersant polymer[2] | 8.89 | 7.54 | 7.54 |
| Enzyme[3] | 3.11 | 3.53 | 2.91 |
| Sodium percarbonate | 12.69 | 14.39 | 11.76 |
| tetraacetylethylenediamine | — | — | 2.91 |
| cobalt catalyst | 0.56 | 1.28 | 1.18 |
| di-propylene Glycol | 3.58 | 3.58 | 3.58 |
| Suds suppressor[4] | 4.16 | 4.16 | 4.16 |
| $C_{10-12}$ alkyl ethoxy (EO9) nonionic surfactant | 0.24 | 0.24 | 0.24 |
| Corrosion inhibitor[5] | 1.0 | 1.0 | 1.0 |
| Dye/perfume/speckles/filler/Water | Balance | Balance | Balance |

[1]such as Polytergent ® SLF-18 from the BASF Corporation
[2]such as Alcosperse ® 246 available from Alco Chemicals
[3]one or more enzymes such as protease, amylase, savinase, natalase and mixtures thereof.
[4]such as Poly-Tergent ® SLF-18 available from the Olin Corporation.
[5]any of the corrosion inhibitors or mixture of corrosion inhibitors listed above.

TABLE 4

Liquid/Gel Rinse Aid Compositions

| Ingredients | 10 (wt %) | 11 (wt %) |
|---|---|---|
| Nonionic surfactant[1] | 35.0 | 35.0 |
| $ZnCl_2$ | 4.0 | 4.0 |
| Citric Acid (50% solution) | 3.13 | 3.13 |
| ethanol | 6.5 | 6.5 |
| sodium cumenesulfonate | 6.62 | 6.62 |
| Corrosion inhibitor[2] | 25 | 50 |
| water/dye/perfume | Balance | Balance |

[1]$C_{12-18}$ alkyl alcohol ethoxylate propoxylate available under the tradename Plurafac ® RA30 from BASF Corporation.
[2]any of the corrosion inhibitors or any mixtures thereof listed above.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method of preventing corrosion of stainless steel, carbon steel or chrome plated flatware in an automatic dishwashing machine comprising the steps of:

placing stainless steel, carbon steel or chrome plated flatware in an automatic dishwashing machine; and contacting the stainless steel, carbon steel or chrome plated flatware with an automatic dishwashing composition comprising a corrosion inhibitor selected from the group consisting essentially of:

a mixture of benzoic acid, ethanolamine and di-fatty acid; a mixture of cyclohexylamine, benzoic acid, ethanolamine and di-fatty acid; a mixture of alkyne nonionic surfactant and a methyl butyrol and any combinations of the above mentioned corrosion inhibitors.

2. The method of claim 1 wherein the automatic dishwashing composition is a through-the-wash formulation.

3. The method of claim 1 wherein the automatic dishwashing composition is a through-the-rinse formulation.

4. The method of claim 1 wherein the automatic dishwashing composition is released during a drying cycle of the automatic dishwashing machine.

5. The method of claim 1 wherein the automatic dishwashing composition further comprises from about 0.0 1% to about 60% by weight of the automatic dishwashing composition of a low-foaming nonionic surfactant.

6. The method of claim 1 wherein the automatic dishwashing composition further comprises from about 0.01 mg to about 3 mg by weight of the composition, of active enzyme per gram of the composition.

7. The method of claim 1 wherein the automatic dishwashing composition further comprises a bleaching system.

8. The method of claim 1 wherein the automatic dishwashing composition further comprises from about 5% to about 50% by weight of the composition of a builder system.

9. The method of claim 1 wherein the automatic dishwashing composition is in a form selected from a solid, a granule, a powder, a liquid, a gel, a paste, a semi-solid, a tablet, a water-soluble pouch, and any combination thereof.

* * * * *